US006617981B2

(12) United States Patent
Basinger

(10) Patent No.: US 6,617,981 B2
(45) Date of Patent: Sep. 9, 2003

(54) TRAFFIC CONTROL METHOD FOR MULTIPLE INTERSECTIONS

(76) Inventor: John Basinger, 1710 Century Ave., Riverside, CA (US) 92506

( * ) Notice: Subject to any disclaimer, the term of this patent is extended or adjusted under 35 U.S.C. 154(b) by 0 days.

(21) Appl. No.: 09/876,441

(22) Filed: Jun. 6, 2001

(65) Prior Publication Data

US 2002/0186147 A1 Dec. 12, 2002

(51) Int. Cl.[7] ..... G08G 1/08

(52) U.S. Cl. ..... 340/909; 340/907; 340/917; 340/934; 340/943; 340/701; 340/117; 340/118

(58) Field of Search ..... 340/909, 907, 340/917, 916, 918, 924, 933, 934, 940, 943, 941, 942; 701/117, 118

(56) References Cited

U.S. PATENT DOCUMENTS

| | | | | | |
|---|---|---|---|---|---|
| 3,631,387 | A | | 12/1971 | Hill et al. | |
| 3,810,084 | A | | 5/1974 | Hoyt, Jr. | |
| 3,816,796 | A | | 6/1974 | Molloy et al. | |
| 4,250,483 | A | | 2/1981 | Rubner | |
| 4,370,718 | A | * | 1/1983 | Chasek | 701/117 |
| 4,449,116 | A | | 5/1984 | Hill et al. | |
| 4,463,339 | A | | 7/1984 | Frick et al. | |
| 4,750,129 | A | * | 6/1988 | Hengstmengel et al. | 701/117 |
| 5,252,969 | A | | 10/1993 | Kishi | |
| 5,257,194 | A | | 10/1993 | Sakita | |
| 5,357,436 | A | * | 10/1994 | Chiu | 701/117 |
| 5,544,059 | A | * | 8/1996 | Hikita et al. | 701/117 |
| 5,659,305 | A | | 8/1997 | Rains et al. | |
| 5,703,778 | A | * | 12/1997 | Takahashi et al. | 701/118 |
| 5,777,564 | A | * | 7/1998 | Jones | 340/917 |
| 5,822,711 | A | | 10/1998 | Ochoa-Chavez | |
| 5,822,712 | A | * | 10/1998 | Olsson | 701/117 |
| 5,917,432 | A | * | 6/1999 | Rathbone | 340/907 |
| 6,313,757 | B1 | * | 11/2001 | Braun | 340/917 |
| 6,317,058 | B1 | * | 11/2001 | Lemelson et al. | 340/910 |
| 6,496,773 | B1 | * | 12/2002 | Olsson | 701/117 |

* cited by examiner

*Primary Examiner*—Nina Tong
(74) *Attorney, Agent, or Firm*—Denton L. Anderson; Sheldon & Mak

(57) ABSTRACT

A method for controlling a plurality of traffic intersections comprising (a) storing traffic flow data and related time data at each traffic intersection in a data storage unit; (b) periodically downloading the traffic flow data and the time data to a computer; (c) using the computer to generate a new set of operating parameters based upon the traffic flow data and the time data; and (d) controlling the plurality of traffic intersections with the new set of operating parameters.

5 Claims, 5 Drawing Sheets

1A
12a
12c
10b
12c
1D
34
12d
10d
12a
1B
1C
12b
10a
12b
10c
12b
12c
12a

TRAFFIC CONTROL METHOD FOR MULTIPLE INTERSECTIONS

FIELD OF THE INVENTION

This invention relates generally to traffic control systems and, more particularly, to traffic control systems for controlling multiple intersections.

BACKGROUND OF THE INVENTION

The flow of traffic along city streets is greatly improved if the traffic signals at related intersections are coordinated. Numerous attempts have been made to coordinate traffic controls at related intersections, but most of these systems rely on interconnecting traffic controllers at the related intersection using hard wire connections. The use of hard wire connection is expensive and environmentally disruptive to construct.

Recently, attempts have been made to coordinate traffic controls at related intersections without the use of hardwire connections. These methods rely on the precise timing of the individual traffic signals using controllers with highly accurate clocks. Each controller controls the traffic signals at an individual intersection based upon a set of detailed control tables. The control tables are prepared from traffic data studies which are periodically conducted at the several intersections.

Unfortunately, such methods which avoid the use of hardwire connections have not been wholly successful. This is because the control tables rapidly become outdated. Traffic control studies are considered awkward, time-consuming and expensive and are therefore infrequently conducted. Thus, the traffic control tables are infrequently, if ever, updated.

Accordingly, there is a need for an improved traffic control method which avoids the aforementioned problems in the prior art.

SUMMARY

The invention satisfies this need. The invention is a method for controlling a plurality of traffic intersections wherein each traffic intersection is defined by the intersection of at least two streets. Each traffic intersection has an alternating traffic control signal for controlling the flow of traffic through the intersection. Also, each traffic intersection has at least one traffic flow sensor for sensing the flow of traffic on at least one of the two streets and for generating traffic flow data derived therefrom. Each traffic intersection also has a clock for measuring time and for generating time data related thereto. Finally, each traffic intersection has a traffic signal controller for controlling the traffic control signal pursuant to a set of one or more operating parameters. The method of the invention comprises the steps of (a) continuously storing the traffic flow data and the time data in a data storage unit, (b) downloading the traffic flow data and the time data from the data storage device to a computer, (c) using a computer to generate a new set of operating parameters for each of the traffic controllers, the new set of operating parameters being derived from the traffic flow data and from the time data, (d) installing the new set of operating parameters into each of the traffic controllers, (e) controlling the plurality of traffic intersections with the traffic controllers after the new sets of operating parameters have been installed in the traffic controllers in step (d), and (f) repeating steps (b)–(e) at least as often as every 180 days.

DRAWINGS

These features, aspects and advantages of the present invention will become better understood with regard to the following description, appended claims and accompanying figures where:

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a method for controlling a plurality of intersections. The invention can be understood with reference to FIG. 1 wherein is shown three major traffic intersections 10, a first major traffic intersection 10*a*, a second major traffic intersection 10*b* and a third major traffic intersection 10*c*. Also shown is a single minor traffic intersection 10*d*. Each traffic intersection 10 is defined by the intersection of at least two streets 12. The first major intersection 10*a* is defined by the intersection of a first thoroughfare 12*a* and a second thoroughfare 12*b*. The second major intersection 10*b* is defined by the intersection of the first thoroughfare 12*a* and a third thoroughfare 12*c*. The third major traffic intersection 10*c* is defined by the intersection of the second thoroughfare 12*b* with the third thoroughfare 12*c*. The minor traffic intersection 10*d* is defined by the intersection of the first thoroughfare 12*a* and a side street 12*d*.

Figure 1:
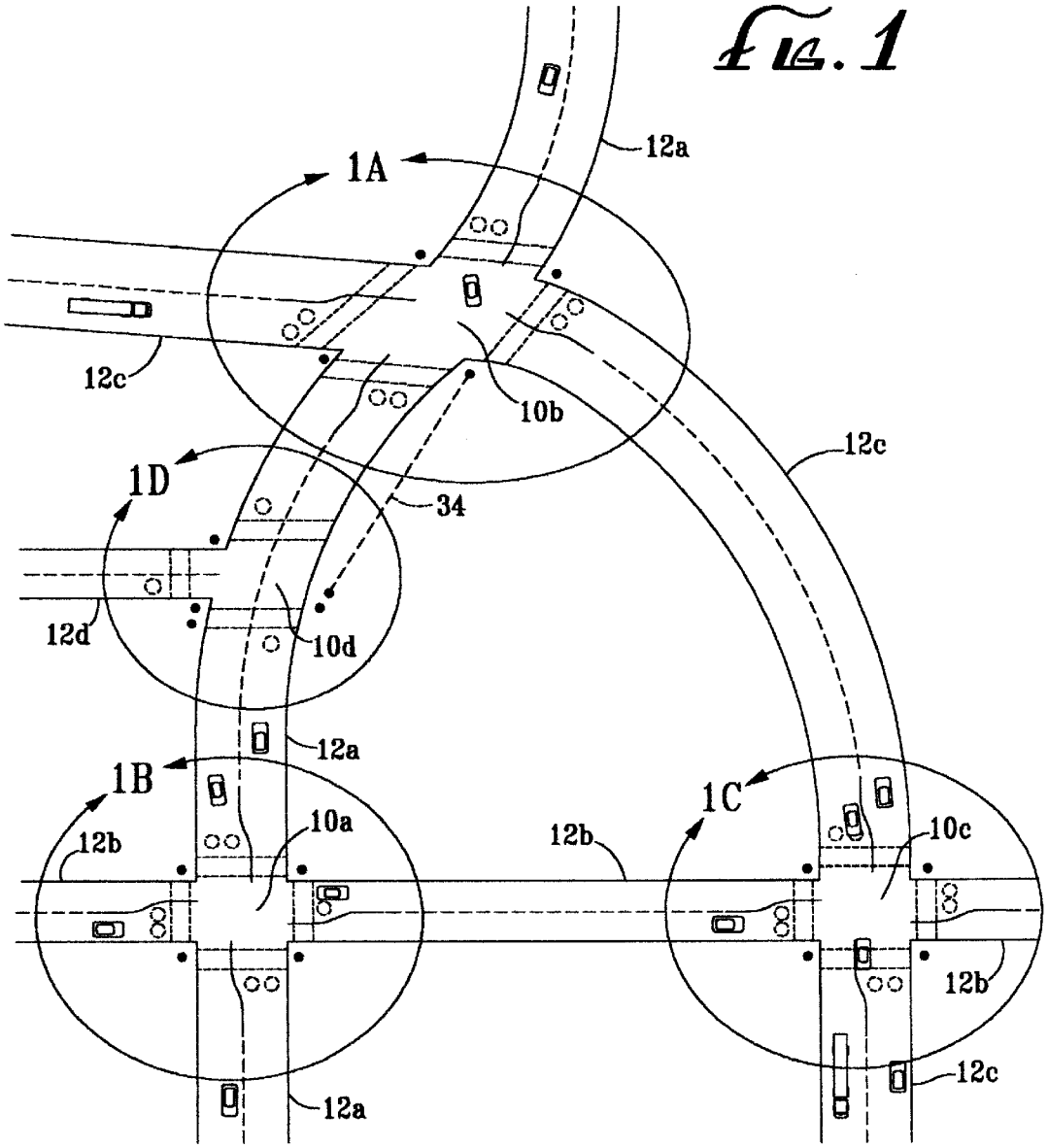
FIG. 1 is a plan view of a typical set of city streets defining a plurality of related intersections which can be controlled by the method of the invention.
Figure 1A:
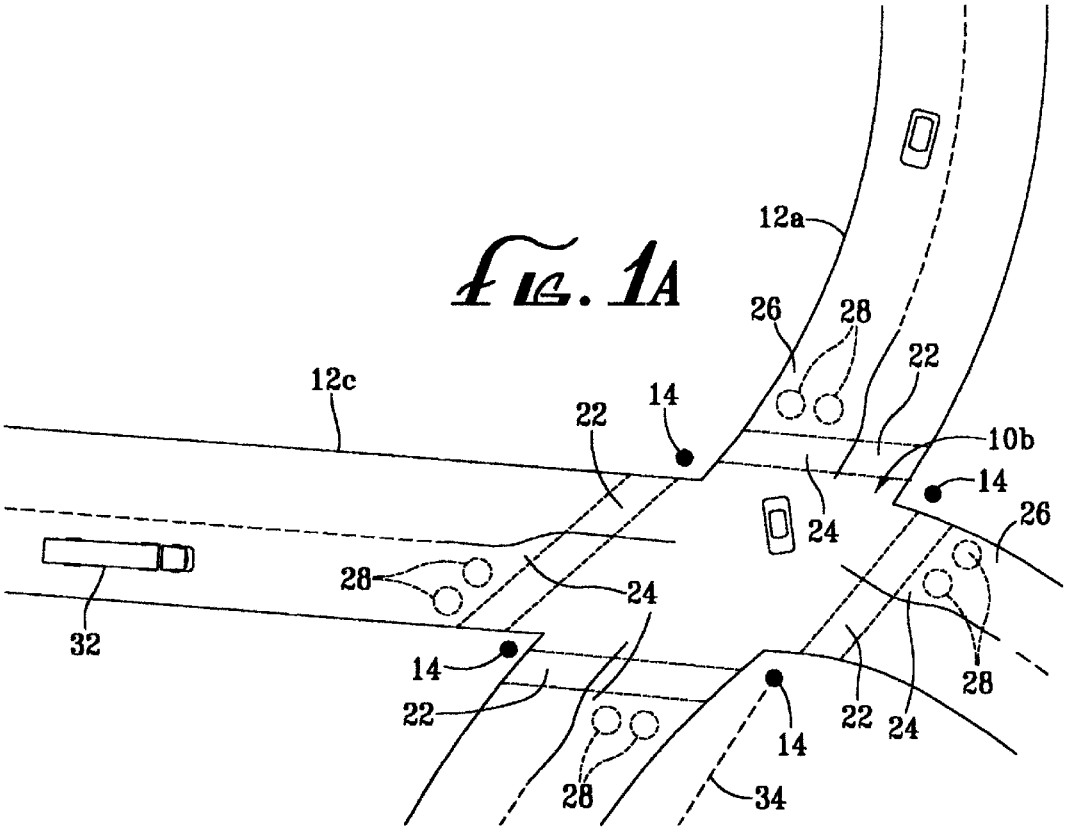
Figure 1D:
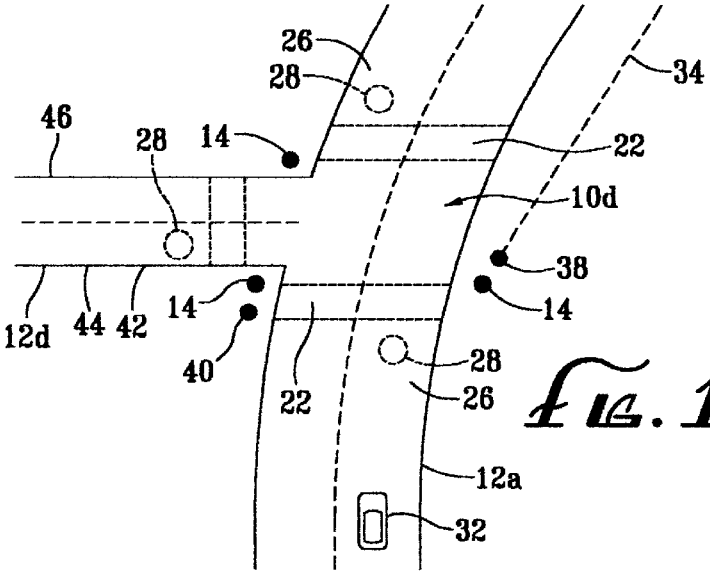
Figure 1B:
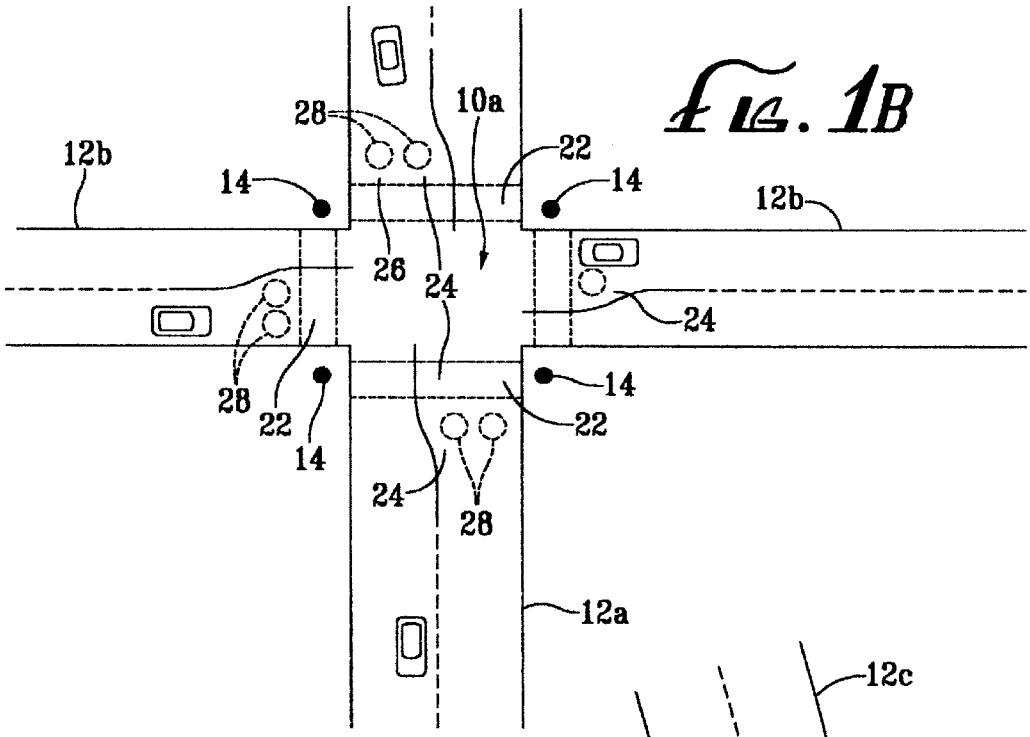
Figure 1C:
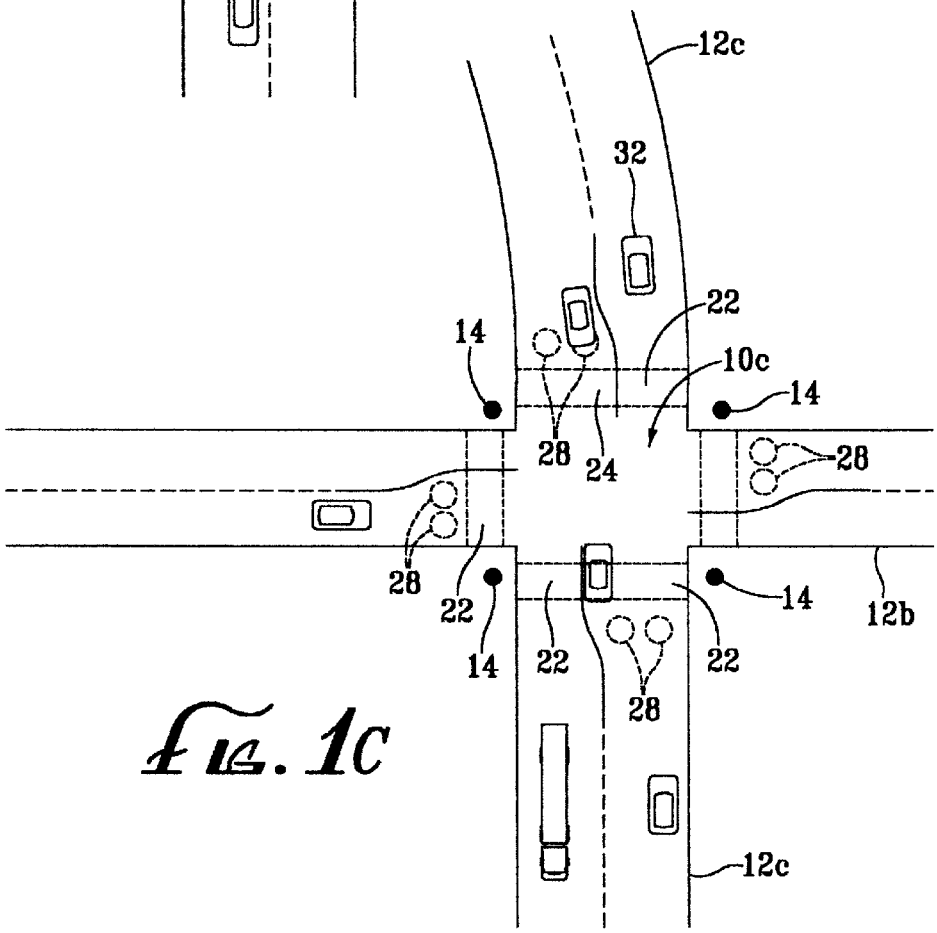
Figure 2:
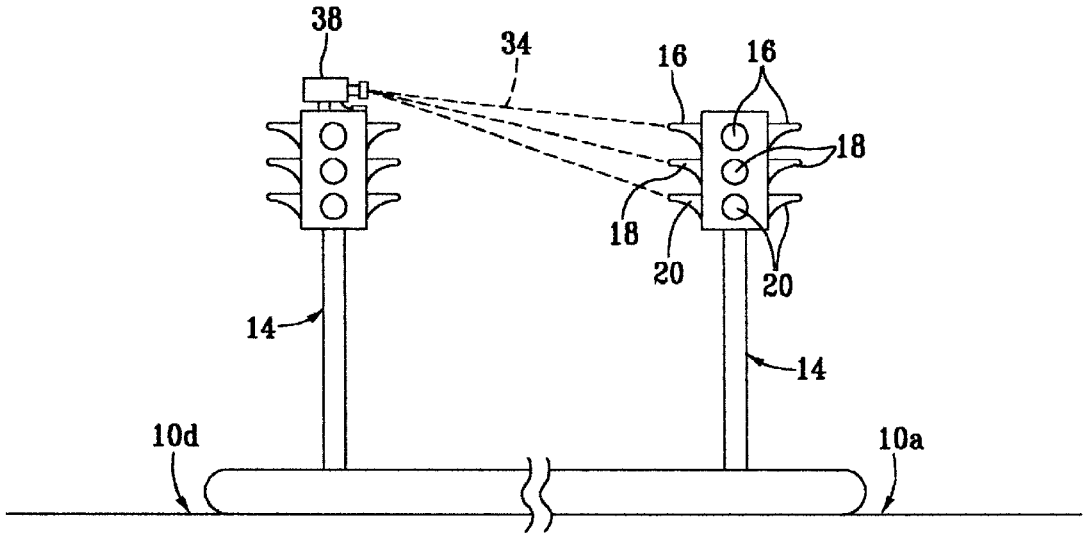
FIG. 2 is a diagrammatic side view of a traffic control system having features of the invention.

Each of the intersections 10 shown in FIG. 1 is controlled by a plurality of alternating traffic control signals 14. Each alternating traffic control signal 14 is typically a three-light traffic control signal which alternatively displays an uppermost red light 16, a centrally disposed amber light 18 and a lower-most green light 20. Such typical traffic control signal 14 is illustrated in FIG. 2.

Each intersection 10 in FIG. 1 also comprises a plurality of pedestrian crosswalks 22. Pedestrian crossing control buttons can be disposed proximate to each crosswalk 22 to change the traffic control signal 14 to allow pedestrian traffic across each crosswalk 22.

Each of the major intersections 10*a*, 10*b* and 10*c* further comprises left turn lanes 24 as well as through traffic lanes 26.

Each traffic intersection 10 further comprises at least one traffic flow sensor 28 for sensing the flow of traffic on at least one of the two streets 12 which define that intersection 10, and for generating traffic flow data therefrom. The traffic flow sensors 28 are typically electrical sensors disposed beneath the pavement in both through traffic lanes 26 and left turn lanes 24 at each intersection 10. Such traffic flow sensors 28 can be loops of wire electrically connected to a traffic flow sensor receiver. Vehicles which pass over the loop of wire disturb the electrical field surrounding the loop of wire. Such disturbance of the electrical field can be "sensed" by the traffic flow sensor 28. Other commonly used traffic flow sensors 28 are designed to sense the increased pressure applied to the pavement by a passing vehicle. Still other traffic flow sensors 28 employ light or other electromagnetic radiation which "sense" the passing of a vehicle through the radiation field.

Typically, the data collected from the traffic flow sensors 28 is a sequence of bits (zeros and ones) where 1 represents a vehicle present and a 0 represents a vehicle not present. The bits are collected at a fixed rate of 1 or 2 Hz. When the traffic flow data changes from 0 to 1, the traffic flow sensor 28 understands that a vehicle is present. If a vehicle is stopped at a red light, the traffic flow data remains at 1.

The traffic flow data also generally includes (a) the fact that a vehicle 32 or a pedestrian is waiting for the right-of-way to proceed; (b) when the traffic signal 14 turns green at a particular direction and how many additional vehicle 32 arrive before the traffic signal 14 turns red; (c) the time period between vehicles 32 after achieving cruising velocity; (d) vehicle 32 acceleration time from a standing stop at each intersection 10; (e) the typical cruising speed towards the next intersection 10; (f) the time needed to clear the intersection 10 when a particular number of vehicles 32 were initially waiting at the intersection 10; and (g) the time needed for pedestrians to clear the intersection 10.

Each of the traffic control signals 14 is controlled by a traffic control signal controller 30 pursuant to a set of one or more operating parameters. Disposed within each traffic signal controller 30 is a clock for measuring time. The clock should be highly accurate, that is, accurate to less than 5 seconds a month. The clock should also be capable of being updated by a primary clock on a daily basis. This allows, for example, the clock to be promptly reset after a power failure.

In one of the most simple embodiments of a traffic signal controller 30 (shown in FIG. 2), the operating parameters consist of a table of instructions instructing the traffic signal controller 30 to change the traffic control signal 14 from red to green when time data derived from the clock indicates the passage of a preestablished first-time interval, changing the traffic control signal 14 from green to amber when time data from the clock indicates the passing of a second time interval and changing the traffic control signal 14 from amber to red when time data from the clock indicates the passing of a third time interval.

In another simple embodiment of a traffic signal controller 30, the traffic signal controller 30 receives traffic flow data from one or more of the traffic flow sensors 28 to indicate when vehicular traffic in one direction of the intersection has been halted for a predetermined length of time as indicated by time data generated by the clock. Many traffic signal controllers 30 at traffic intersections 10 also are programmed to control the traffic control signals 14 at each intersection 10 based upon a wide variety of different traffic flow conditions (as sensed by the traffic flow sensors 28) and as instructed by a complex set of operating parameters. The operation of a typical traffic signal controller 30 is described in U.S. Pat. No. 5,257,194, the entirety of which is incorporated herein by this reference.

Typically, each traffic signal controller 30 continuously consults an internal table for some or all of the following information: (a) which direction within the intersection 10 has a default right of way; (b) what are the times and durations of mandatory changes of right-of-way; and (c) what are the times, priorities and durations in which traffic flow sensors 28 are active for triggering right-of-way changes. (The default right-of-way is the right-of-way given when no mandatory right-of-way is active and all traffic flow sensors 28 are inactive.) Preferably, the traffic signal controller 30 has an override feature which allows emitting equipment from emergency vehicles to override its internal table directives. The traffic signal controller 30 can also include a mandatory change of right-of-way, that is, the granting of right-of-way to a given direction at a specific time independent of any traffic flow sensors 28.

The elements of the internal table of the traffic flow signal controller 30 can be created with the goal of minimizing vehicle 32 wait time, or for minimizing vehicle 32 acceleration, or for minimizing carbon monoxide output or for some other rational goal. Creating the operating parameters within the table can be accomplished using a non-linear system of equations with side constraints that can be solved by various operations research techniques. Performance of the various mathematical operations necessary to create and/or update the parameters within the internal table can generally be accomplished by a relatively fast PC.

In the method of the invention, traffic flow data from the traffic flow sensors 28 and related time data from the clock are stored in a data storage unit. The data storage unit can be a complex intersection wherein 32 sensors are recorded at 2 hz. The data storage unit typically requires at least about 0.7 Mbytes of random access memory per day. It might be expected, therefore, that to store 180 days of data, the data storage unit would require 126 Mbytes. However, since the transition states of 0 to 1 and 1 to 0 need only be stored in the data storage unit, with proper data compression as little as 12 Mbytes of RAM is sufficient for storing 6 months of data. Where necessary, traffic flow data and time data can be stored in a circular buffer. For example, where the data storage unit is configured to store 180 days of data, if the data storage unit has not been emptied after 180 days, data for the 181st day is written over the data for the first day.

Periodically, the traffic flow data and the time data is downloaded from the data storage unit to a computer, such as a PC operating at greater than about 800 MHz. The computer is used to generate a new set of operating parameters based upon the traffic flow data and the time data. This new set of operating parameters are then installed into each of the traffic signal controllers 30 and the traffic signal controllers 30 are used to control the plurality of traffic intersections 10 using the new sets of operating parameters.

The generation of the new set of operating parameters uses a wide variety of algorithms and mathematical analysis methods known in the art. Many off-the-shelf computer programs are presently available to perform some or all of the computations performed by the computer in the invention. Such off-the-shelf programs include TRANSYT, SCOOT, SCATS, SOAP, MAXBAND, PASSER II-80, PASSER III, SIGOP and MOTION. The algorithms necessary to accomplish this computation in the computer produce a set of switching tables for the several traffic flow signal controllers. The primary inputs for the algorithms might be maximum allowable wait times for each phase at each intersection 10, a traffic flow model for each phase, distance between intersections 10, legal sets of phases at each intersection 10 and statistical traffic flow data for each phase. Because any legal phase may follow the current phase, multiple sets of very large sparse systems of equations are then "solved" in the computer using, for example, linear programming.

In one embodiment of the invention, each set of operating parameters comprises a table having a plurality of operating instructions and each traffic signal controller 30 controls its respective traffic intersection 10 using the operating instructions from its respective table. Each table is indexed by the traffic signal controller 30 at least as often as twice every second.

In a typical embodiment of the invention, the traffic flow data might include the number of vehicles 32 passing through each intersection 10 on each street per unit time at various intervals of the day and night. The traffic flow data may also include the amounts of time that a vehicle 32 remains stopped at a traffic flow signal 14 along each street 12 at each traffic intersection 10. Such traffic flow data and time data are accumulated in a data storage unit typically disposed at each traffic intersection 10. The accumulated traffic flow data and time data is then downloaded to a computer and the computer is used to generate new sets of operating parameters based upon various traffic control strategies. In one such strategy, the computer would apply algorithms to maximize traffic flow through all or some of the intersections 10 at one or more times during the day or night. In another strategy, the computer would use algorithms calculated to create operating parameters which would minimize the cumulative time that vehicles 32 were stopped at one or more of the intersections 10 during various periods of the day or night. In yet another strategy, the computer could apply algorithms calculated to maximize the flow of traffic along one or more of the several streets which make up the plurality of traffic intersections 10.

Using the method of the invention, operating parameters can be derived which will continually adjust the traffic flow signal switching intervals during all hours of the day and night. For example, traffic may be very light at one or more of the traffic intersections 10 during most of the night hours, except that the traffic may become very heavy during a shift change at a local factory. Similarly, traffic flow at one or more of the plurality of intersections 10 may be quite light during most times in the afternoon, but may become quite heavy when classes let out at a local school. By accumulating traffic flow data and time data throughout all hours of the day and night, the method of the invention is able to recognize such temporary peak traffic periods and to adjust traffic signal switching intervals to maximize traffic flow efficiency.

The computer used to generate the new operating parameters will typically be disposed off site, away from each of the various traffic intersections 10. In locations where high speed internet connections are available, the computer can be located anywhere. If and when tiny computers become sufficiently fast and powerful, the computers may be locatable proximate to one or more of the intersections 10.

In another embodiment of the invention, the method of controlling the plurality of traffic intersections 10 further comprises the steps of (i) monitoring a first street 12 within a first traffic intersection 10 with the traffic flow sensors to identify when the first street 12 is unduly congested; (ii) communicating the fact that the first street 12 is unduly congested to the traffic flow signal controller at the first traffic intersection 10; and (iii) controlling the first traffic intersection 10 with the traffic signal controller 30 at the first traffic intersection 10 to allow increased traffic through the first traffic intersection 10 along the first street 12 so as to decongest the first street 12.

As illustrated in FIGS. 1 and 2, the method of the invention can further comprise a video camera 38 disposed proximate to a first traffic intersection 10. The video camera 38 is capable of viewing the traffic control signal 14 at a second intersection 10 and emitting a corresponding output signal to the traffic flow signal controller at the first traffic intersection 10 to control the traffic control signal 14 at the first traffic intersection 10 based, in part, upon signal changes at the second traffic intersection 10. The video camera 38 must be able to distinguish between the red signal 16 and the green signal 20 of a standard traffic control signal 14 at the second intersection 10. However, because the intense red and green are never transmitted simultaneously, it is only necessary to define a zone of pixels which will always contain both the red light and the green light (and the miscellaneous non-emitting background). The field of view of the video camera 38 must be limited to the traffic control signal 14 and its non-emitting background. A video camera controller used to control the video camera 38 is programmed to read only the red and green pixel locations, so as to continually determine if the pixels are "redder" or "greener."

In embodiments of the invention using such a video camera 38, the method further comprises the steps of sensing signal changes at the second traffic flow signal 14 using the video camera 38 and emitting a corresponding output signal from the video camera 38 to the first traffic flow signal controller 30. The first traffic signal controller 30 then controls the traffic flow at the first traffic intersection 10 based in part upon the signal changes at the second traffic control signal 14.

The drawings illustrate this embodiment of the invention. In the drawings, a video camera 38 is disposed at the minor traffic intersection 10*d* in FIG. 1 and is focused on the traffic control signal 14 at the first major intersection 10*a* along a sight line 34. When the traffic control signal 14 at the first major traffic intersection 10*a* is green along the first thoroughfare 12*a*, the traffic signal controller 30 at the minor traffic intersection 10*d* controls the traffic control signal 14 at the minor intersection 10*d* so that traffic flowing through the first major intersection 10*a* does not have to stop at the minor intersection 10*d*.

Figure 3A:
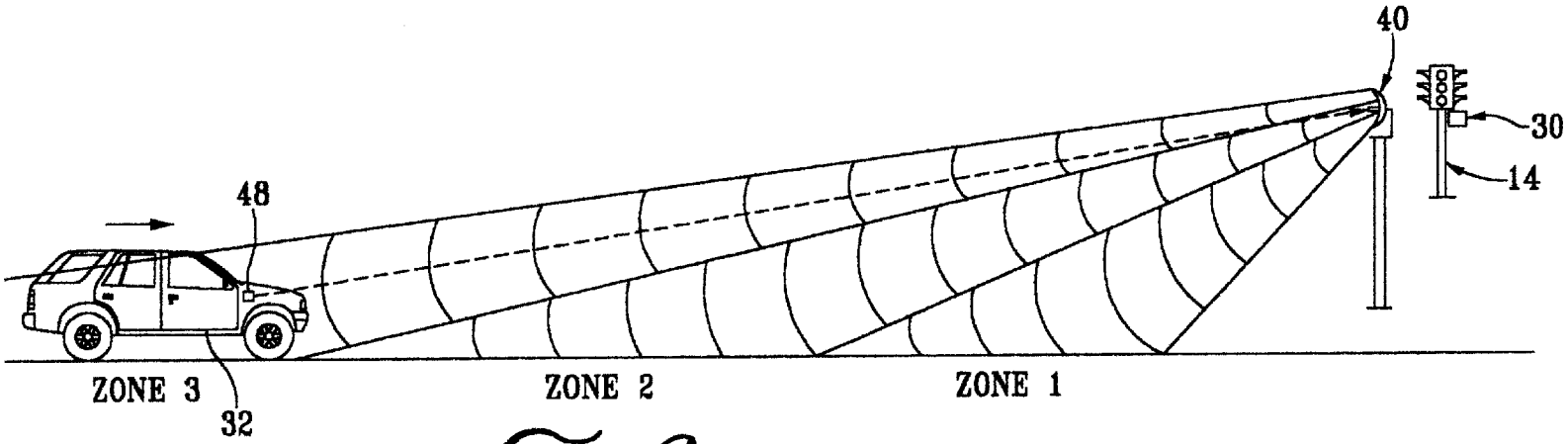
FIG. 3A is a diagrammatic side view of a second traffic control system having features of the invention.
Figure 3B:
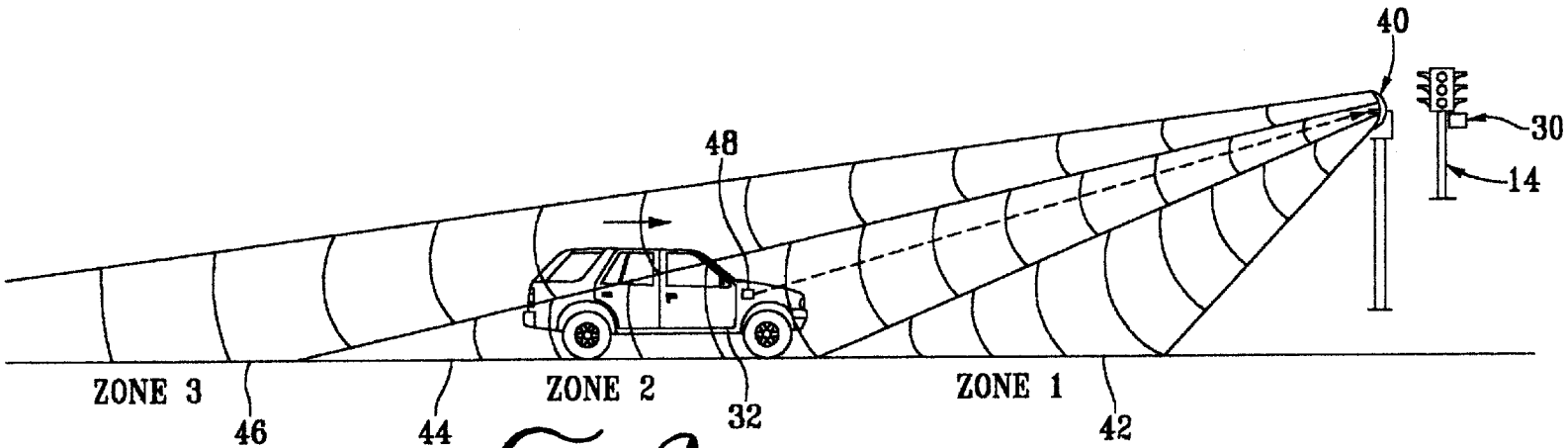
FIG. 3B is a diagrammatic side view of the traffic control system shown in FIG. 3A, illustrating the use of the system as a vehicle proceeds along a street monitored by the control system.

As illustrated in FIGS. 1, 3A and 3B, the method of the invention can further comprise the use of a traffic flow sensor 28 comprising a plurality of signal emitters 40. Each signal emitter 40 is adopted to transmit the signal embodied in a wireless transmission signal to a different portion of a roadway 12. In one version of this embodiment, the signal emitters 40 are a set of infrared emitters all transmitting on the same infrared color. The first emitter 40 illustrates a first zone 42 of the roadway 12, for example, a stretch of the roadway between about 100 and 200 feet from the emitters. The second emitter 40 illuminates a second zone 44 of the roadway 12, for example, the second stretch of the roadway 12 between about 200 and about 400 feet from the emitters. The third emitter 40 illuminates a third zone 46 of the roadway 12, for example, a stretch of the roadway 12 400 to 600 feet from the emitters 40. Additional emitters 40 can be used to illuminate additional roadway portions. All of the zones 42, 44 and 46 are illuminated with IR (color blue), but zone 1 turns off and on (with a square wave) at 1 KHz, zone 2 turns off and on at 2 KHz and zone 3 turns off and on at 4 KHz.

In this embodiment, a mobile transponder 48 adapted as both a receiver and a transmitter is employed in some or all of the vehicles 32. The mobile transponder 48 receives the IR (color blue) signal from the emitters 40 and echos the received signal back on another IR color (e.g., color yellow). The red and yellow colors do not interfere with each other. The echo in this embodiment is 1 KHz, 2 KHz or 4 KHz in the IR "yellow" band. The traffic signal controller 30 receives some of echoed IR yellow band signals. The traffic signal controller 30 separates the signals and correlates the received sum of each of the signals separately. Each signal with a correlation above a fixed threshold (e.g., 0.1) indicates to the traffic signal controller 30 that a vehicle 32 is in the zone attached with the signal. The traffic signal controller 30 uses the processed IR signal information as a transitional traffic sensor input. A filtering circuit can be used to "ignore" continuous signals being sent from stalled or otherwise stationary vehicles 32 on the roadway 12.

Thus, in this embodiment of the invention, the control of at least one of the traffic intersections 10 comprises the additional steps of (i) emitting a first wireless transmission signal from a first traffic signal controller 30 to a first portion of the first street 12 defining the intersection 10; (ii) emitting a second wireless transmission signal from the first traffic signal controller 30 to a second portion of the first street 12; (iii) receiving the first wireless transmission signal at the first portion of the first street 12 by a mobile transponder 48; (iv) transmitting a first corresponding wireless transmission signal from the mobile transponder 48 to the first signal flow controller 30, the first corresponding wireless transmission signal being a reflection of the first wireless transmission signal; (v) moving the mobile transponder 48 to the second portion of the first street 12; (vi) receiving the second wireless transmission signal at the second portion of the first street 12 by the mobile transponder 48; and (vii) transmitting a second corresponding wireless transmission signal from the mobile transponder 48 to the first traffic signal controller 30, the second corresponding wireless transmission signal being a reflection of the second wireless transmission signal. In this embodiment, the first traffic signal controller 30 thereby "senses" that the mobile transponder has moved from the first portion of the first street 12 to the second portion of the first street 12.

The drawings illustrate this embodiment of the invention. In the drawings, a plurality of signal emitters 40 are disposed at the minor traffic intersection 10*d*. The emitters 40 are focused up the side street 12*d*, away from the minor traffic intersection 10*d*. The signal emitters illuminate each of three zones along the side street 12*d*, a first zone 42 most proximate to the minor intersection 10*d*, a second zone 44 immediately beyond the first zone 42 and a third zone 46 immediately beyond the second zone 44. Using this embodiment of the invention, a vehicle 32 approaching the minor intersection 10*d* along the side street 12*d* is "sensed" by the combined use of the emitter 40 illuminating the third zone 46 of the side street 12*d* and the mobile transponder 48 located within the vehicle 32. As the vehicle 32 passes from zone 3 to zone 2 to zone 1, the traffic signal controller 30, using input from the plurality of emitters 40, can monitor progress of the vehicle 32 as it approaches the minor intersection 10*d*. The traffic signal controller 30 can therefore be programmed to change the traffic control signal 14 at the minor intersection 10*d* to allow the vehicle 32 approaching on the side street 12*d* to enter the minor intersection 10*d* without having to appreciably slow or stop.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A method for controlling a plurality of traffic intersections, each traffic intersection being defined by the intersection of at least two streets and each traffic intersection comprising (i) an alternating traffic control signal for controlling the flow of traffic through the intersection, (ii) at least one traffic flow sensor and one clock for sensing the flow of traffic on at least one of the two streets as a function of time and for generating time-related traffic flow data derived therefrom, (iii) a data storage unit for storing the time-related traffic flow data and (iv) a traffic signal controller for controlling the traffic control signal pursuant to a set of one or more time-related operating parameters, neither the traffic flow sensor, the clock, the data storage unit or the controller at any of the individual intersections being networked with that of any other intersection, the method comprising:

(a) continuously gathering and storing the time-related traffic flow data at each intersection;

(b) downloading the time-related traffic flow data from the data storage device at each intersection to a computer;

(c) using the computer to generate a new set of time-related operating parameters for each of the traffic controllers, the new set of operating parameters being derived from the time-related traffic flow data;

(d) installing the new set of time-related operating parameters into each of the traffic controllers;

(e) controlling the plurality of traffic intersections with the traffic controllers after the new sets of operating parameters have been installed in the traffic controllers in step (d); and (f) repeating steps (b)–(e) at least as often as every 180 days.

2. The method of claim 1 wherein each set of time-related operating parameters comprises a table having a plurality of operating instructions and wherein each traffic signal controller controls one of the traffic intersections in step (e) using the operating instructions from its respective table, the table being indexed by the traffic signal controller at least as often as twice every second.

3. The method of claim 1 comprising the additional steps of:

(f) monitoring a first street within a first traffic intersection with the traffic flow sensors to identify when the first street is unduly congested;

(g) communicating the fact that the first street is unduly congested to the traffic signal controller at the first traffic intersection; and (h) controlling the first traffic intersection with the traffic signal controller at the first traffic intersection to allow increased traffic through the first traffic intersection along the first street so as to decongest the first street.

4. The method of claim 1 wherein the plurality of traffic intersections comprises a first traffic intersection defined by a first street and a second street and having a first traffic flow sensor, the method comprising the additional steps of:

(f) emitting a first wireless transmission signal from the first traffic signal controller to a first portion of the first street;

(g) emitting a second wireless transmission signal from the first traffic signal controller to a second portion of the first street;

(h) receiving the first wireless transmission signal at the first portion of the first street by a mobile transponder;

(i) transmitting a first corresponding wireless transmission signal from the mobile transponder to the first traffic signal controller, the first corresponding wireless transmission signal being a reflection of the first wireless transmission signal;

(j) moving the mobile transponder to the second portion of the first street;

(k) receiving the second wireless transmission signal at the second portion of the first street by a mobile transponder; and (l) transmitting a second corresponding wireless transmission signal from the mobile transponder to the first traffic signal controller, the second corresponding wireless transmission signal being a reflection of the second wireless transmission signal, whereby the first traffic signal controller senses that the mobile transponder in step (j) has moved from the first portion of the first street to the second portion of the first street.

5. The method of claim 1 wherein the plurality of traffic intersections comprises (i) a first traffic intersection defined by the intersection of a first street and a second street, the first traffic intersection having a first traffic signal controller, and (ii) a second traffic intersection defined by the intersection of the second street and a third street, the second traffic intersection having a second traffic signal, the method further comprising the steps of:

(f) sensing signal changes at the second traffic signal by a video camera disposed proximate to the first traffic intersection and emitting a corresponding output signal from the video camera to the first traffic signal controller; and (g) controlling the traffic flow at the first traffic intersection by the first traffic signal controller.

* * * * *